US012108822B1

(12) United States Patent
Parkinson

(10) Patent No.: US 12,108,822 B1
(45) Date of Patent: Oct. 8, 2024

(54) VISOR SYSTEMS AND RELATED METHODS

(71) Applicant: Brimware LLC, Provo, UT (US)

(72) Inventor: David Hugh Parkinson, Provo, UT (US)

(73) Assignee: Brimware LLC, Provo, UT (US)

( * ) Notice: Subject to any disclaimer, the term of this patent is extended or adjusted under 35 U.S.C. 154(b) by 0 days.

(21) Appl. No.: 17/932,185

(22) Filed: Sep. 14, 2022

Related U.S. Application Data

(60) Provisional application No. 63/261,186, filed on Sep. 14, 2021.

(51) Int. Cl.
*A42B 1/0184* (2021.01)

(52) U.S. Cl.
CPC ..... *A42B 1/0184* (2021.01)

(58) Field of Classification Search
CPC ..... A42B 1/0184; A42B 1/0185; A42B 1/24; A42B 1/247; A42B 1/0187; A42B 1/018; A42B 1/0181; A42B 1/0182; A42B 1/0183; A42B 1/0186; A42B 1/0188; A42B 1/205; A42B 1/0175; A41F 1/002
See application file for complete search history.

(56) References Cited

U.S. PATENT DOCUMENTS 3,372,443 A * 3/1968 Daddona, Jr. ..... A41F 1/002 24/303
D349,596 S 8/1994 Booth
D377,108 S 1/1997 Schulz
D396,945 S 8/1998 Glass
5,901,371 A 5/1999 Lee
6,122,774 A 9/2000 Park
(Continued)

FOREIGN PATENT DOCUMENTS

CN 113768232 A * 12/2021
DE 202015005352 U1 * 12/2015 ..... A42B 1/064
(Continued)

OTHER PUBLICATIONS

Overade Removable Cloth Visor, published online at least as early as Aug. 28, 2015, available at https://www.amazon.com/Overade-Removable-Cloth-Foldable-Helmet/dp/B00XKP1JT8, last accessed Apr. 26, 2024.

(Continued)

*Primary Examiner* — Amy Vanatta
(74) *Attorney, Agent, or Firm* — Law Office of Paul B. Johnson; Paul B. Johnson

(57) ABSTRACT

Disclosed herein is a visor system including a bill portion configured to bend enough to conform to a bent curvature of a hat bill. The bill portion includes a front curved section and a rear curved section. A first component of a magnetic pair is at least partially encapsulated within the bill portion. The visor system includes an auxiliary portion having a second component of the magnetic pair at least partially encapsulated therein. The magnetic pair includes at least one magnet and at least one other element that is either a magnet or a magnetizable material. The magnetic pair allows the bill portion to be moved to various positions and rotations, while coupled to the hat bill, to provide added shade and the like. The bill portion is flexible enough that as it is moved and rotated it conforms to the existing bent curvature of the hat bill.

19 Claims, 8 Drawing Sheets

(56) References Cited

U.S. PATENT DOCUMENTS

| | | | | |
|---|---|---|---|---|
| 6,163,889 | A * | 12/2000 | Tate | A63B 57/353 2/209.13 |
| 6,473,907 | B1 | 11/2002 | Harwood | |
| RE38,774 | E | 8/2005 | Davis | |
| 6,959,454 | B2 | 11/2005 | DeWinter | |
| D627,140 | S | 11/2010 | Dyer | |
| D724,821 | S | 3/2015 | Kim | |
| 9,078,483 | B1 | 7/2015 | Snyder | |
| D779,790 | S | 2/2017 | Valverde | |
| D817,606 | S | 5/2018 | Hester | |
| D832,559 | S | 11/2018 | Burmester | |
| D833,121 | S | 11/2018 | Darby | |
| D833,716 | S | 11/2018 | Hester | |
| D862,847 | S | 10/2019 | Emery | |
| 10,757,993 | B2 | 9/2020 | Son | |
| 10,820,651 | B1 | 11/2020 | Armendariz | |
| D985,891 | S | 5/2023 | Shafovaloff | |
| D1,007,108 | S | 12/2023 | Fuller, Jr. | |
| 2005/0235395 | A1 | 10/2005 | Tseng | |
| 2007/0033775 | A1 | 2/2007 | Hsiao | |
| 2012/0110718 | A1 | 5/2012 | Kim | |
| 2012/0260399 | A1 | 10/2012 | Verbout | |
| 2013/0061431 | A1* | 3/2013 | Naftali | H01F 7/0263 24/303 |
| 2013/0125291 | A1* | 5/2013 | Davidson | A42B 1/0184 2/209.12 |
| 2013/0125292 | A1 | 5/2013 | Weaver et al. | |
| 2013/0326791 | A1* | 12/2013 | Woo | A42B 1/0187 2/172 |
| 2015/0150726 | A1* | 6/2015 | Flaxman | A42B 1/0181 128/858 |
| 2015/0327613 | A1* | 11/2015 | Kay | A42B 1/242 2/209.13 |
| 2017/0055618 | A1* | 3/2017 | Fulper | A42B 1/22 |
| 2017/0245574 | A1 | 8/2017 | Danko | |
| 2017/0347733 | A1* | 12/2017 | Durand, Jr. | A42B 1/0184 |
| 2018/0146734 | A1* | 5/2018 | Kelly | A42B 1/004 |
| 2018/0206573 | A1* | 7/2018 | Hall | A42B 1/24 |
| 2019/0142096 | A1 | 5/2019 | Skinner | |
| 2019/0174856 | A1* | 6/2019 | Bowles et al. | A42B 1/24 |
| 2020/0121013 | A1* | 4/2020 | Heller | A42B 1/205 |
| 2020/0253310 | A1 | 8/2020 | Meadows | |
| 2021/0100308 | A1* | 4/2021 | Smith | A42B 1/206 |
| 2021/0251326 | A1* | 8/2021 | Smith, III | A42B 1/0184 |

FOREIGN PATENT DOCUMENTS

| | | | | |
|---|---|---|---|---|
| FR | 2839861 | A3 * | 11/2003 | A42B 1/064 |
| KR | 101102832 | B1 | 1/2011 | |
| KR | 20110010807 | U * | 11/2011 | |
| KR | 20120035692 | A * | 4/2012 | |
| KR | 300710509.0000 | | 9/2013 | |
| KR | 301081250.0000 | | 11/2020 | |
| KR | 301153973.0000 | | 3/2022 | |

OTHER PUBLICATIONS

Lumos Ultra Visor, published online at least as early as Sep. 23, 2021, available at https://www.amazon.com/Lumos-Ultra-Visor-Size-M/dp/B09GYLTM51, last accessed Apr. 26, 2024.

Hat Brim Support Wool Cap, published online at least as early as Mar. 20, 2024, available online at https://www.aliexpress.us/item/3256806315558401.html, last accessed Apr. 26, 2024.

* cited by examiner

VISOR SYSTEMS AND RELATED METHODS

CROSS REFERENCE TO RELATED APPLICATIONS

This document claims the benefit of the filing date of U.S. Provisional Patent Application No. 63/261,186, entitled "Extendable visor for hats," naming as first inventor Mr. David Hugh Parkinson, which was filed on Sep. 14, 2021, the disclosure of which is hereby incorporated entirely herein by reference.

BACKGROUND

1. Technical Field

Aspects of this document relate generally to hats and visors.

2. Background Art

Many hats include brims or visors. Some visors extend all the way around a head portion of a hat, such as with a cowboy hat. Other visors only extend partly around the head portion of a hat, such as with the bill of a baseball cap. Visors are useful for keeping the sun off of one's neck and/or face. However, depending on the angle of the sun and other factors, the visor of a hat is not always sufficient to keep the sun off of a user's face and/or neck as desired, or as much as desired.

SUMMARY

Implementations of visor systems may include: a bill portion configured to bend enough to conform to a bent curvature of a hat bill, the bill portion including: a front curved section; a rear curved section; and a first component of a magnetic pair coupled with the bill portion; and an auxiliary portion, the auxiliary portion comprising a second component of the magnetic pair; wherein the magnetic pair includes a first magnet and one of a second magnet and a magnetizable material.

Implementations of visor systems may include one or more or all of the following:

An upper side of the bill portion may be sized and shaped to be fully covered by the hat bill when in a stowed position.

An underside of the bill portion may include a plurality of ridges separated by gaps.

The ridges may have a fanned-out configuration.

Each of the ridges may be wider at the front curved section than it is at the rear curved section.

The bill portion may further include a heat shield at least partially encapsulated therein and coupled with the first component of the magnetic pair. The heat shield may be at least partially exposed through the bill portion. The heat shield may be formed of one of a metal, a ceramic, and a composite material.

The auxiliary portion may further include a heat shield at least partially encapsulated therein and coupled with the second component of the magnetic pair. The heat shield may be at least partially exposed through the auxiliary portion. The heat shield may be formed of one of a metal, a ceramic, and a composite material.

The first component of the magnetic pair may be at least partially encapsulated within a cavity of the bill portion and may be at least partially exposed through the bill portion.

The second component of the magnetic pair may be at least partially encapsulated within a cavity of the auxiliary portion and may be at least partially exposed through the auxiliary portion.

Implementations of visor systems may include: a bill portion configured to bend enough to conform to a bent curvature of a baseball cap bill, the bill portion including: a front curved section; a rear curved section; a plurality of ridges separated by gaps; and a first magnet at least partially encapsulated within a cavity of the bill portion; and an auxiliary portion, the auxiliary portion including a second magnet at least partially encapsulated within a cavity of the auxiliary portion.

Implementations of visor systems may include one or more or all of the following:

The ridges may form a circular, fanned configuration fanned out from a common axis, the common axis not intersecting the bill portion but being closer to the rear curved section than to the front curved section.

The ridges may form a fanned configuration such that, within a range of at least ninety degrees of rotation of the bill portion relative to the baseball cap bill, along an axis of rotation passing through the auxiliary portion and the bill portion when magnetically coupled together, at least one of the gaps is parallel to an axis of bending of the baseball cap bill.

The auxiliary portion may include a plurality of bumps at least partially forming an X shape.

The bill portion may further include a first heat shield completely covering a surface of the first magnet and the auxiliary portion may include a second heat shield completely covering a surface of the second magnet.

Implementations of methods of use of visor systems may include: coupling a bill portion of a visor system under a hat bill such that the bill portion bends to match a bent curvature of the hat bill and such that the hat bill fully covers an upper side of the bill portion; and coupling an auxiliary portion of the visor system over the hat bill such that a first component of a magnetic pair, at least partially encapsulated within the bill portion, magnetically couples with a second component of the magnetic pair at least partially encapsulated within the auxiliary portion, the magnetic pair retaining the visor system in a stowed configuration, wherein the magnetic pair comprises a first magnet and one of a second magnet and a magnetizable material.

Implementations of methods of use of visor systems may include one or more or all of the following:

The method may include moving the bill portion to an in-use position such that the hat bill does not fully cover the upper side of the bill portion, and rotating the bill portion along an axis passing through the bill portion and the auxiliary portion, wherein the auxiliary portion automatically follows the movement of the bill portion due to the magnetic pair being magnetically coupled, and wherein the bill portion automatically bends to conform to the bent curvature of the hat bill upon movement and rotation of the bill portion.

General details of the above-described implementations, and other implementations, are given below in the DESCRIPTION, the DRAWINGS, the CLAIMS and the ABSTRACT.

BRIEF DESCRIPTION OF THE DRAWINGS

Implementations will be discussed hereafter using reference to the included drawings, briefly described below, wherein like designations refer to like elements. The drawings are not necessarily drawn to scale.

DESCRIPTION

Implementations/embodiments disclosed herein (including those not expressly discussed in detail) are not limited to the particular components or procedures described herein. Additional or alternative components, assembly procedures, and/or methods of use consistent with the intended visor systems and related methods may be utilized in any implementation. This may include any materials, components, sub-components, methods, sub-methods, steps, and so forth.

Figure 8:
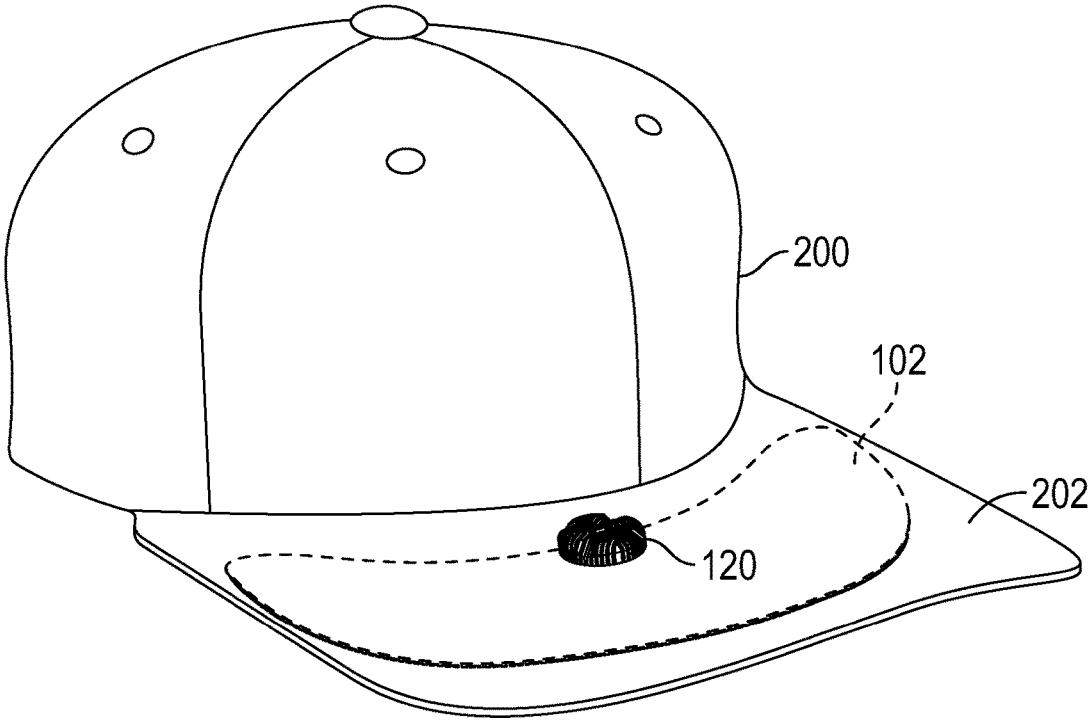
FIG. 8 is a top, front, right side, perspective view of the visor system of FIG. 1 in a stored position coupled with a hat.
Figure 9:
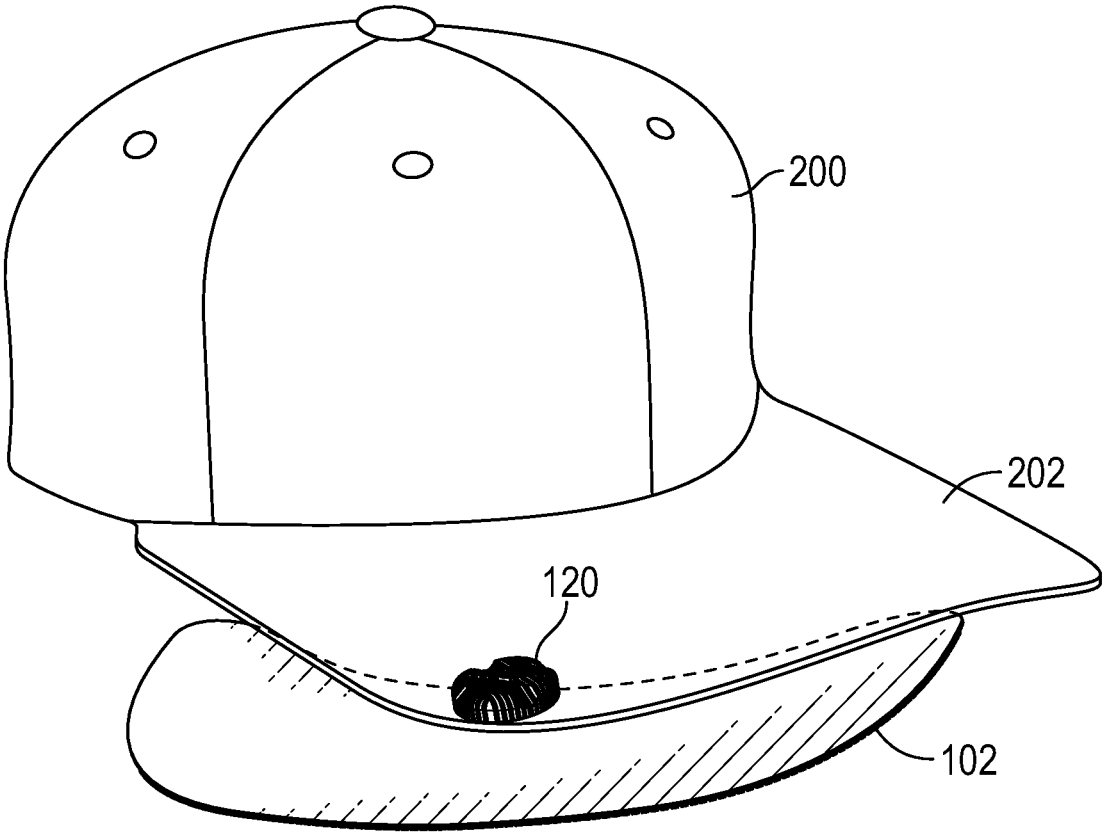
FIG. 9 is a top, front, left side, perspective view of the visor system of FIG. 1 in an in-use position coupled with a hat.

Referring to FIGS. 1-15, an implementation of a visor system (system) 100 is shown. The system includes a bill portion 102 and an auxiliary portion 120. The bill portion includes a front curved section 104 and a rear curved section 106. These are generally useful to allow the bill portion to reside fully hidden and fully underneath a bill 202 of a hat 200 (such as by non-limiting example a traditional baseball cap) in a stored or stowed position, as seen in FIG. 8. Curved corners between the front curved section and rear curved section ensure that the bill portion does not poke the user's head or face if the bill portion comes into contact therewith—in this sense the bill portion does not have the same exact shape of the bill of the cap, though it is seen to have a similar or substantially similar shape. In implementations the arc of the front curved section may match the arc of the front of a bill of a baseball cap, for maximum coverage/protection against the sun but also to ensure that the bill portion can fit fully underneath the bill of the cap. In implementations the rear curved section may have a wider arc than that shown in the drawings and/or may have a wider arc than the front curved section. This may be useful so that the visor system is more comfortable to the user when the bill portion is slid to a side in-use position (such as in FIG. 9, or further to the side and away from the front of the hat bill). In some implementations the bill portion could exactly match the shape of the hat bill, including the front curved sections and rear curved sections mirroring similar sections of the hat bill, which may allow for even more shade in some implementations—but may also make side in-use positions more difficult in some implementations.

The bill portion has a flat surface 108 on its upper side and, on its bottom side, ridges 110. In implementations the ridges add strength to the bill portion such as by increasing rigidity along the front-to-back direction (or in other words decreasing or disallowing bending along a side-to-side axis), but also allowing bending along the side-to-side direction (or in other words allowing bending along a front-to-back axis) so that, for example, the bill portion can curve to match the curvature of the hat bill. In general the ridges may make the bill portion less likely to snap or break, increasing the durability of the bill portion.

The bill portion could be formed of a variety of materials, such as any polymer having sufficient rigidity but also sufficient bendability. In implementations the bill portion may be formed of 0.6 mm thick (including the ridges or not including the ridges) acrylonitrile butadiene styrene (ABS) or polylactic acid (PLA). The thickness, however, could be less than 0.6 mm, or greater than 0.6 mm, depending on the desired rigidity and bendability and the characteristics of the polymer used. Non-polymer materials could be used, such as a cardboard element covered with cloth (similar to some hat bills). In implementations the thickness (including or not including ridges) may be less than 0.5 mm, less than 1.0 mm, less than 1.5 mm, less than 2.0 mm, less than 2.5 mm, less than 3.0 mm, less than 3.5 mm, less than 4.0 mm, and so forth.

A raised portion 112 on the bill portion includes or at least partially includes/defines a cavity 114, and a magnet 116 is situated within the cavity. A heat shield 118 is coupled over the magnet within the cavity 114.

The auxiliary portion 120 similarly includes a flat surface 122 on its underside, ridges 124 on its upper side, a cavity 126, and magnet 128 within the cavity. A heat shield 130 is coupled over the magnet within the cavity 126. The flat surfaces of the bill portion and auxiliary portion allow for easy sliding of each portion along the hat bill while they are magnetically coupled to one another.

The bill portion and auxiliary portion, each having a magnet therein, work in concert with one another to provide desired shade or other protection (such as from rain, snow, etc.) to the user. In the stored and in the in-use configurations the magnets of the auxiliary portion and the bill portion are aligned, as seen in the drawings, so that the attractive force between them keeps the bill portion and auxiliary portion each coupled to the hat bill. At the same time, the user may slide the bill portion in any direction or position, such as for shade or other protection, and the attractive force of the magnets causes the auxiliary portion to simply follow the bill portion around as the user slides the bill portion. Similarly, in implementations the user could slide the auxiliary portion in a desired direction and this could be a method for automatically moving the bill portion in the same direction due to the magnetic coupling. In these ways, the bill portion may be easily slid to any position, while staying coupled to the hat bill, for the user to provide shade or other protection as desired, and to easily store the visor system in the stored position (as in FIG. 8) when desired. While the user is moving the bill portion from position to position, the ridges and general flexibility may allow the bill portion to easily curve to match the curvature of the hat bill at any position/angle.

Although the auxiliary portion is shown having ridges, in implementations these do not serve a similar bending functionality as with the bill portion, since the auxiliary portion in general will not need to bend. Accordingly, in implementations the ridges/gaps of the auxiliary portion may be excluded. In implementations the auxiliary portion may be formed of the same material(s) as the bill portion.

The magnets 116 and 128 may have different sizes and gauss ratings, the sizes and gauss ratings selected according to the desired use. Additionally, while the magnets shown in the drawings are cylindrical magnets, other shapes could be used according to the desired end use or aesthetics. In the example shown in the drawings the bill portion has a single magnet 116 and the auxiliary portion has a single magnet 128. In implementations one or the other could instead have multiple magnets. For example the magnet 116 could be replaced by four magnets each having equal strength with one another (or varying strengths) to form a quad magnet. Other configurations are possible, as desired by the user. In implementations magnet 116 is shorter or more squat and/or is otherwise smaller, such as having a smaller diameter, than magnet 128, so as to produce less of a bump on the underside of the bill portion, so that the raised portion 112 is less likely to interfere with the user's sight. The attractive force between the magnets may be tailored, by tailoring the magnet dimensions and gauss ratings and other qualities, so that the magnetic force is strong enough to keep the bill portion and auxiliary portion magnetically coupled but not so strong as to prevent smooth, easy operation when moving the bill portion from position to position. The magnet and raised portion sizes may also be tailored so that they do not disrupt or overly disrupt the bendability of the bill portion, so that the bill portion can match the curvature of the hat bill as the bill portion is moved around. The magnetic attraction may also be strong enough so that even as the bill portion is forced into different curvatures, to match the curvature of the hat bill, any downward force of the bill portion from the forced curvature does not cause the bill portion to separate and fall down, but it instead remains coupled to the hat bill due to the sufficiently strong attractive force between the magnets.

Using a single magnet on each portion may result in a lower overall total radius of the magnets (for example while four smaller magnets could be used instead of one larger magnet, the four magnets may have a larger perimeter around the area they occupy than one larger magnet would have). This may result in farther allowed travel for the bill portion or, in other words, the bill portion may be able to travel to further distances from its stored position. On the other hand, using multiple magnets, such as a quad mag as described above, may be more useful in some ways for curved brims, because the bill portion may be allowed to curve between its multiple magnets, thus allowing it more available total curvature. A quad magnet or other version with multiple magnets may, however, allow for less travel, and may add cost to manufacturing and materials. In either case, the practitioner of ordinary skill in the art may select the desired magnet configuration according to the expected end use.

In implementations the bill portion may be designed to protect the user from ultraviolet (UV) rays and the like. Because the bill portion may be slid from side to side, from front to back, and diagonal and in any other direction, while still remaining coupled to the hat bill due to the magnets, the user can wear the hat in any desired direction or configuration and can slide the bill portion to any desired position for desired blocking of the sun, UV rays, rain, wind, and so forth.

Figure 3:
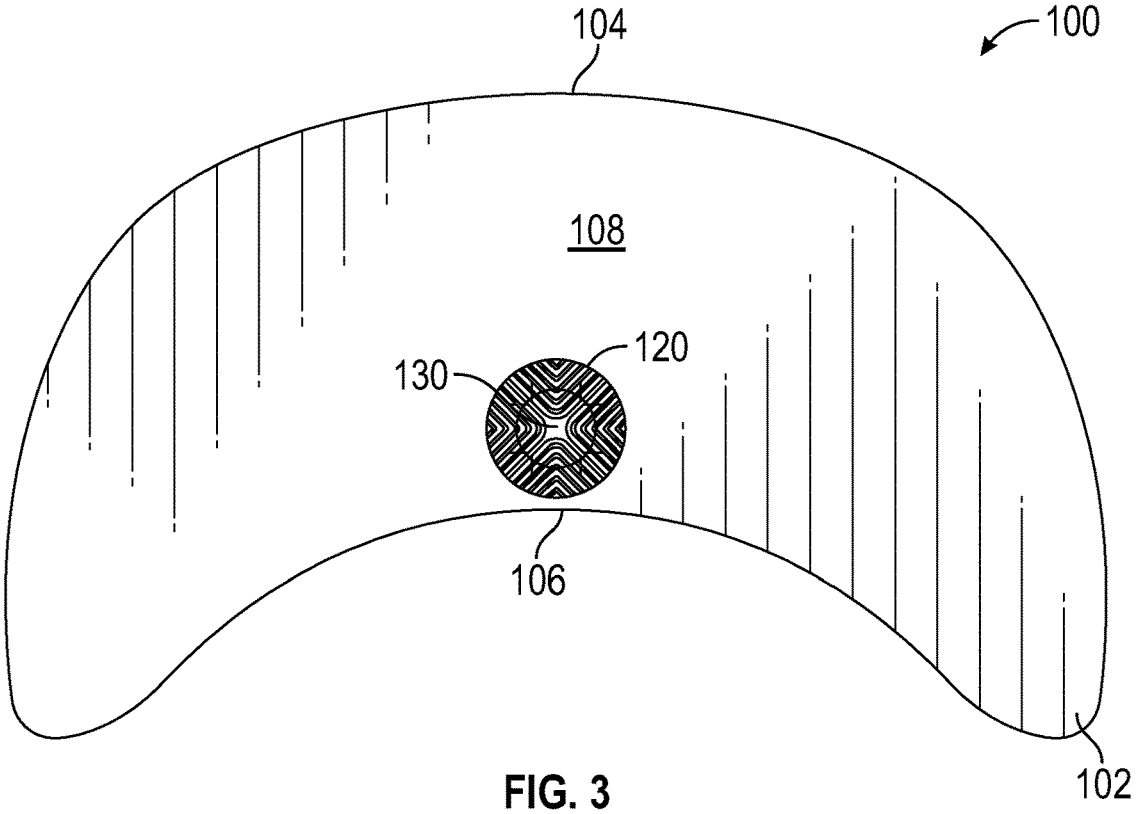
FIG. 3 is a top view of the visor system of FIG. 1.
Figure 4:
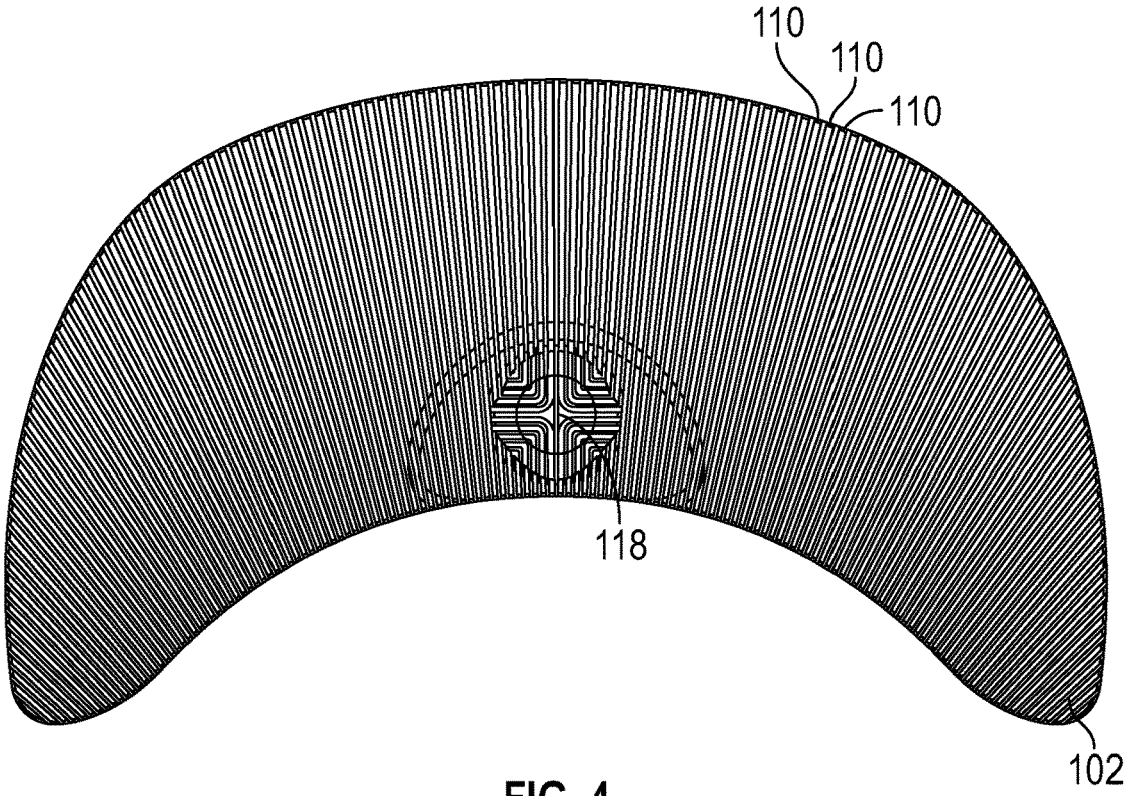
FIG. 4 is a bottom view of the visor system of FIG. 1.
Figure 5:
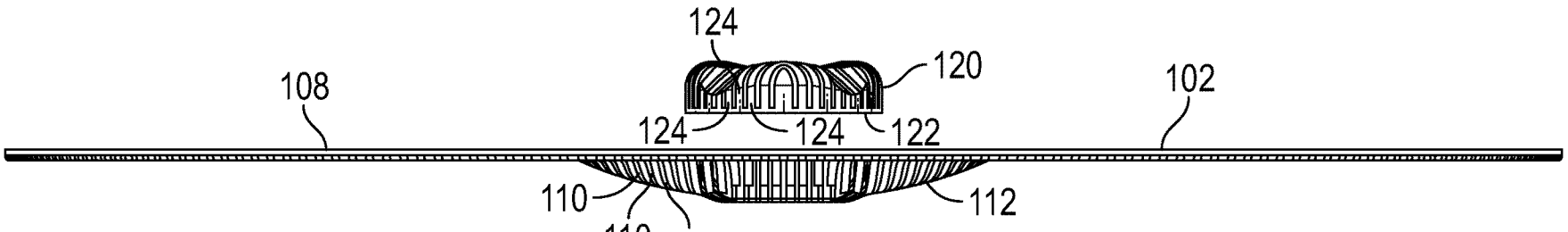
FIG. 5 is a front view of the visor system of FIG. 1.
Figure 6:
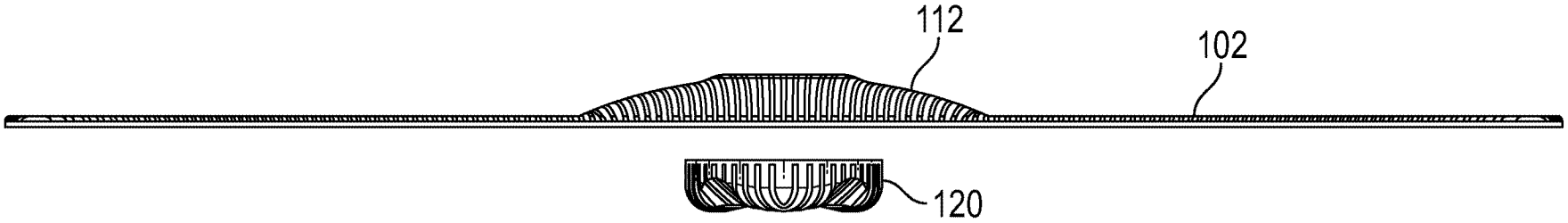
FIG. 6 is a rear view of the visor system of FIG. 1.
Figure 7:
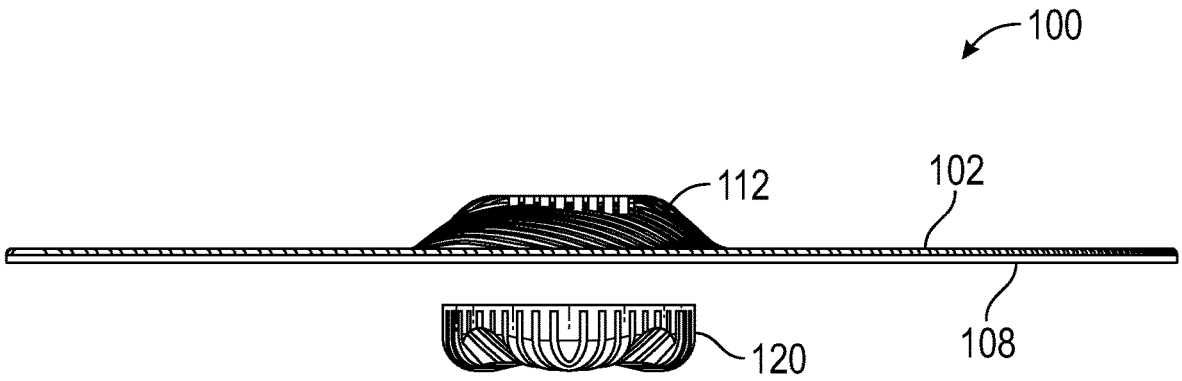
FIG. 7 is a right side view of the visor system of FIG. 1, the left side view being a mirror image.
Figure 12:
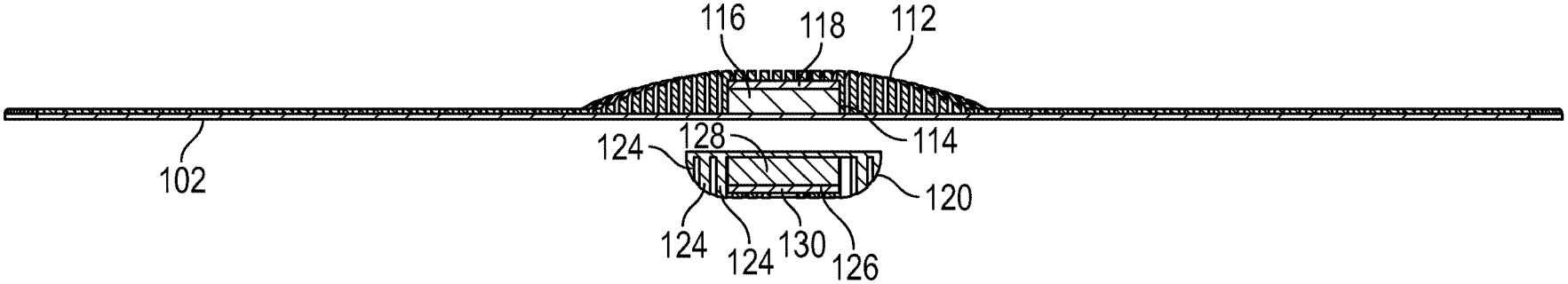
FIG. 12 is a front cross section of the bill portion of the visor system of FIG. 1.
Figure 13:
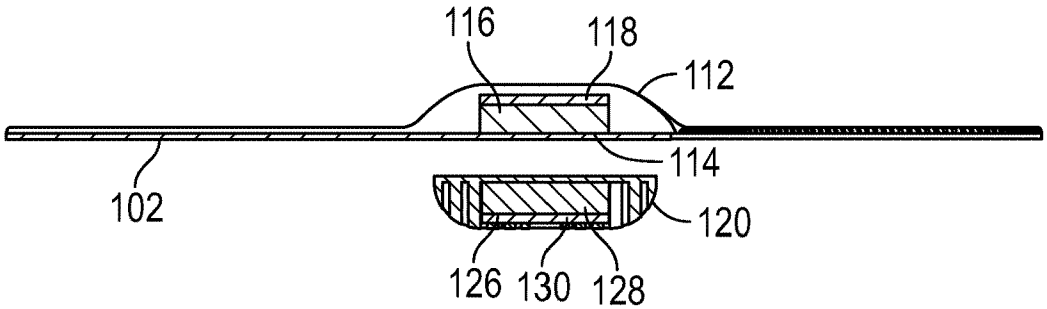
FIG. 13 is a right side cross section of the bill portion of the visor system of FIG. 1.
Figure 14:
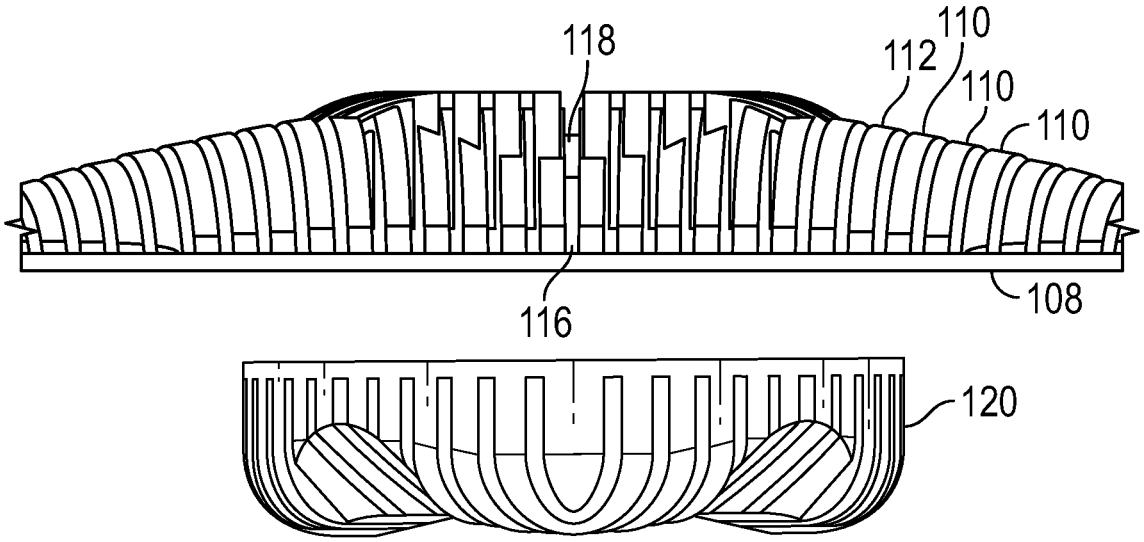
FIG. 14 is a close-up rear view of the visor system of FIG. 1.
Figure 15:
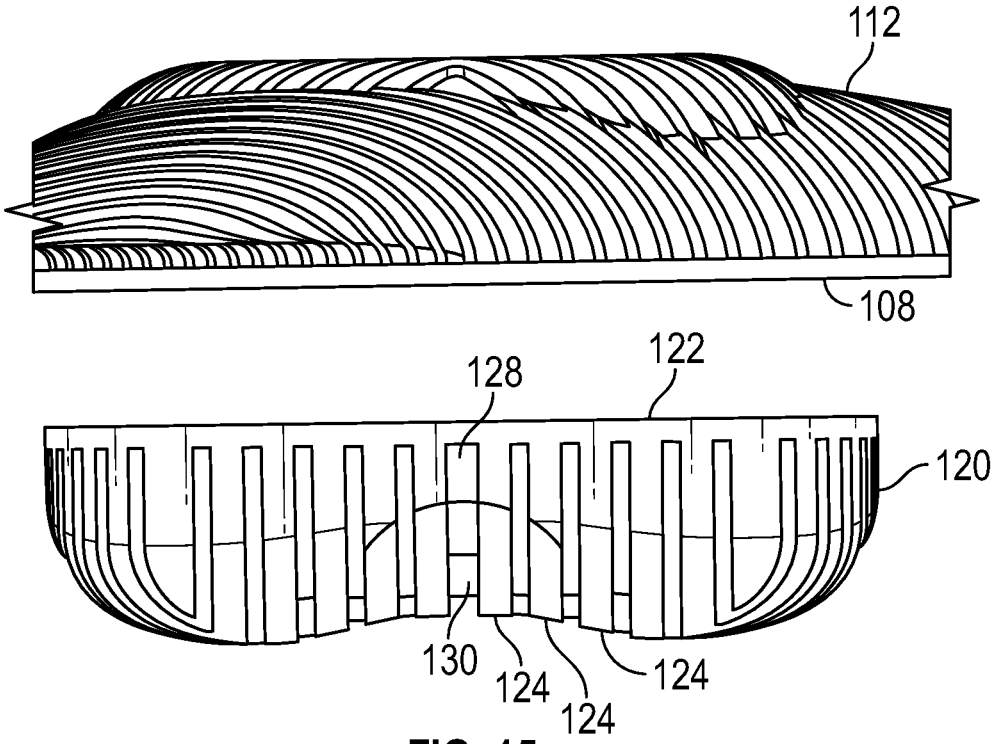
FIG. 15 is a close-up rear, left side view of the visor system of FIG. 1.

In implementations the magnets may have approximately twenty pounds of holding force between them. The magnets may be formed of a wide variety of magnetic materials. In implementations the magnets are neodymium magnets. In the drawings the magnets are seen to be cylindrical but as mentioned they could have other shapes such as rectangular or cuboidal or rectangular cuboidal or any other regular or irregular three-dimensional shape. The magnets are fully or partially encased in the polymer or other material of the respective portions. For example, referring to FIG. 13, magnet 116 is seen to be partially encased within cavity 114—with bill portion 102 encasing some of the sides and all of the bottom of the magnet, and the heat shield 118 fully encasing the top of the magnet (top and bottom here referring to the top and bottom of the page, respectively). The heat shield 118 is, in turn, partly encased within the material of the bill portion, but is also partially exposed through openings or gaps in the bill portion, as seen in FIGS. 4, 12, and 14, and the magnet 116 is also partially exposed through openings or gaps in the bill portion, as seen in FIG. 14. Referring to FIG. 13 magnet 128 is seen to be partially encased within cavity 126—with auxiliary portion 120 encasing some of the sides and all of the top of the magnet, and the heat shield 130 fully encasing the bottom of the magnet (top and bottom here referring to the top and bottom of the page, respectively). The heat shield 130 is, in turn, partly encased within the material of the auxiliary portion, but is also partially exposed through openings or gaps in the auxiliary portion, as seen in FIGS. 3 and 14, and the magnet 128 is also partially exposed through openings or gaps in the bill portion, as seen in FIG. 15. In other implementations the bill portion could be designed to more fully encase its magnet and/or heat shield, so that either or both are fully enclosed—but leaving them somewhat exposed may allow the bill portion to more easily bend as needed, proximate the magnet and heat shield, notwithstanding the relative rigidity of the magnet and heat shield. The auxiliary portion could, similarly, be designed to fully encase either its magnet or its heat shield, or both. In implementations the magnet 116 could be rounded, such as having an ovoid or flattened sphere shape, or otherwise simply rounded at the edges between the top/bottom and side surfaces, so as to facilitate easier bending of the bill portion.

In implementations the bill portion may have dimensions slightly smaller than those of the hat bill so that the bill portion can remain hidden in the stored or stowed configuration regardless of the curvature of the hat bill.

The ridges are both for function and design. The baffles or grooves between the ridges of the bill portion allow the bill portion to flex to accommodate the curved shape of the hat bill, and at the same time the ridges partially house the magnet 116 and heat shield 118. In some implementations if the bill portion had no ridges and corresponding baffles or grooves proximate the magnet 116 and heat shield 118, it may be too rigid to conform well, or to fully conform, to the shape of the hat bill. The ridges and baffles/grooves are also aesthetically pleasing.

In implementations the auxiliary portion could be modified to be larger and to have mounting elements such as for mounting or storing a camera, headlamp, sunglasses, a metal parts tray (which itself could be magnetic and could be used to hold bits, screws, etc.), or the like. Alternatively, in some cases such elements (like a magnetized metal parts tray, which may be magnetized with the same magnets that secure the auxiliary portion to the hat bill) may simply be integrally formed into or with the auxiliary portion. In such implementations there may be more magnets used, such as using three magnets in tripod fashion on each of the bill portion and auxiliary portion instead of the single magnet on each portion so that the auxiliary and bill portions are secured magnetically strongly enough that the auxiliary portion can securely hold the camera, headlamp, etc. The stronger magnetism, and the larger size of the auxiliary portion, allows for heavier accessories. The number and configuration of magnets may further be adjusted as needed for heavier or lighter mounted elements.

In implementations the visor systems may include other elements such as for sporting activities like golf, running, and/or for sports spectators. In implementations a magnetic tee may be coupled with the auxiliary portion and a ball marker may be coupled either with the auxiliary portion or with the bill portion, such as for golfers to use while golfing. These may be coupled magnetically, mechanically, or using other coupling mechanisms.

Various manufacturing methods may be used to form the visor systems. One example is to three-dimensionally (3D) print each portion out of polyethylene terephthalate glycol (PETG). PETG has a high temperature resistance (such as to withstand the heat of being left in a hot car) and a high UV resistance (such as to prevent degradation and brittleness due to sun exposure and/or to help protect the user from UV rays). PETG has a lower 3D printer bed temperature and a lower extrusion temperature than other polymers such as acrylonitrile styrene acrylate (ASA), acrylonitrile butadiene styrene (ABS), polycarbonate (PC), polypropylene (PP), and so forth. The temperature at which neodymium magnets begin to lose their permanent magnetic field is 80 C. PETG is extruded at the 3D filament using a nozzle temperature of 210-250 C and using a bed temperature between 70-80 C. Accordingly, during 3D printing each portion is printed flat-side first and the 3D printer and the cavity is partially formed, and then the bed temperature is reduced at a layer prior to the enclosing print layer (which encloses the magnet) so that the print is below 80 C (in some cases 75 C) by the time the magnet is inserted. The magnet is inserted into the cavity, and the heat shield placed atop it, and then 3D printing continues to partially encapsulate each. In implementations the heat shield comprises a 1 mm thick steel disc that acts as a heat sink to ensure that the magnet never gets over 80 C.

To get the PETG to consistently stick to a steel heat shield a glue may be applied to the heat shield to create a tacky surface. Just before inserting the magnet with the heat shield both are heated to 75 C (the bed temperature) to help with adhesion. After completing 3D printing the printed portion may be lightly hand sanded and then pressure washed to remove sanding dust and the glue off of the heat shield. Polymer heat shields have been tried (glued to the magnet before inserting them) but in experiments they were not found to provide enough heat shielding. Another option is to print the bill portion and the auxiliary portion each in two pieces, then insert the magnet, and then use acetone welding to weld the two pieces together in each case. While this does work, it is messier, more labor intensive and creates a less reliable configuration.

Although the above manufacturing methods simply discuss a single magnet and heat shield, the fabrication steps apply both to the bill portion and the auxiliary portion and steps may be repeated when either the bill portion or auxiliary portion includes multiple magnets or heat shields. The heat shields are useful for protecting the magnets during fabrication of the bill portion and auxiliary portion, so that the magnets do not demagnetize or otherwise have their magnetism negatively affected during hot three-dimensional printing of the bill portion and auxiliary portion. In implementations, instead of steel the heat shield is a 1 mm thick carbon fiber composite heat shield. The heat shield of each portion may be formed of a metal material, a ceramic material, a composite material, or a combination thereof. As indicated previously, the heat shield and the magnet are each partially exposed through the bill portion and/or auxiliary portion, respectively. This has been described as being useful for bending, but in implementations it may also be useful for helping with heat dissipation from the magnet, the heat shield, and the printed component during 3D printing, so that the magnet does not heat up to a point where its magnetism is removed or negatively affected. Although 3D printing is described herein as one fabrication technique, the practitioner of ordinary skill in the art may select other fabrication techniques, and 3D printing is just one example.

The ridges of each portion were designed based on a 3D printing process using PETG and a 0.4 mm nozzle, which has been found to be the optimal nozzle for this size print. The ridges of the bill portion go from 0.8 mm to 1.2 mm thickness end to end. For this nozzle size and material configuration this has been found to give the cleanest, most efficient print. Although the ridge size and/or gap/baffle size between ridges could be selected to be other sizes, these were found to be the optimal sizes for the 3D printing process with a 0.4 mm nozzle and PETG.

There are other manufacturing techniques that can and have been used to form the bill portion and auxiliary portion out of acrylonitrile styrene acrylate (ASA), and one advantage of ASA is its matte and non-shiny appearance which in some implementations may be more desirable. In implementations in which the portions are formed of ASA, higher temperatures may be required during 3D printing or other manufacturing techniques, and even though this can cause some demagnetization, such effects can be mitigated by using larger magnets (for either the auxiliary or bill portion or both) so that the amount of demagnetization that occurs does not prevent the magnets from having sufficient attraction for use of the visor system. For example, in one case the magnet used for the auxiliary portion was a neodymium magnet and its thickness or height was increased by 1/16 inch, and this resulted in sufficient magnetic attraction notwithstanding the higher temperatures needed for forming the portions out of ASA.

The ridges are fanned out in a circular pattern. The direction or position of the ridges determines the direction in which the visor bends. The fanned nature of the ridges helps to ensure that the bill portion bends in the appropriate direction. For example, when the bill portion is in an in-use direction out to the right of the hat bill, the far left side of the bill portion's ridges are now on average parallel with the axis of bend of the hat bill, thus allowing the bill portion to conform to the curvature of the hat bill. A similar situation occurs when the bill portion is in an in-use direction out to the left, or when the bill portion is in an in-use direction directly in front of the hat bill—the fanned nature of the ridges ensuring that in any position some of the ridges are parallel with the bend of the hat bill so that the bill portion can conform to the hat bill curvature. A variety of different diameter circles have been tried for the axis of the fanned ridge pattern, and the bill portions in the drawings use a 152 mm diameter circle (the axis of which does not intersect with the bill portion but which is closer to the rear curved section than the front curved section), which has been found to result in effective fanning of the ridges for allowing the bill portion to effectively conform to the curvature of the hat bill in any in-use position. Other diameters could be used, however, such as plus or minus 1 mm, 2 mm, 3 mm, 4 mm, 5 mm, 10 mm, 15 mm, 20 mm, 25 mm, 30 mm, 35 mm, 40 mm, 45 mm, 50 mm, and so forth of the 152 mm diameter size.

Figure 1:
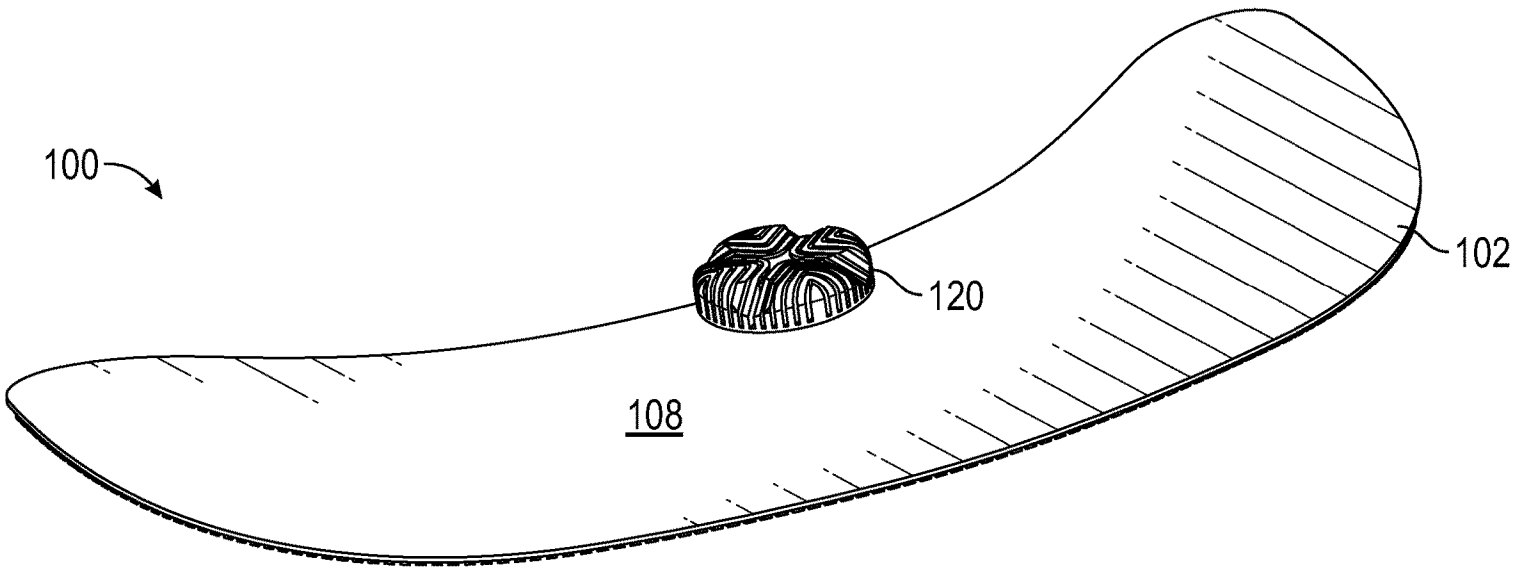
FIG. 1 is a top, front, right side, perspective view of an implementation of a visor system.
Figure 2:
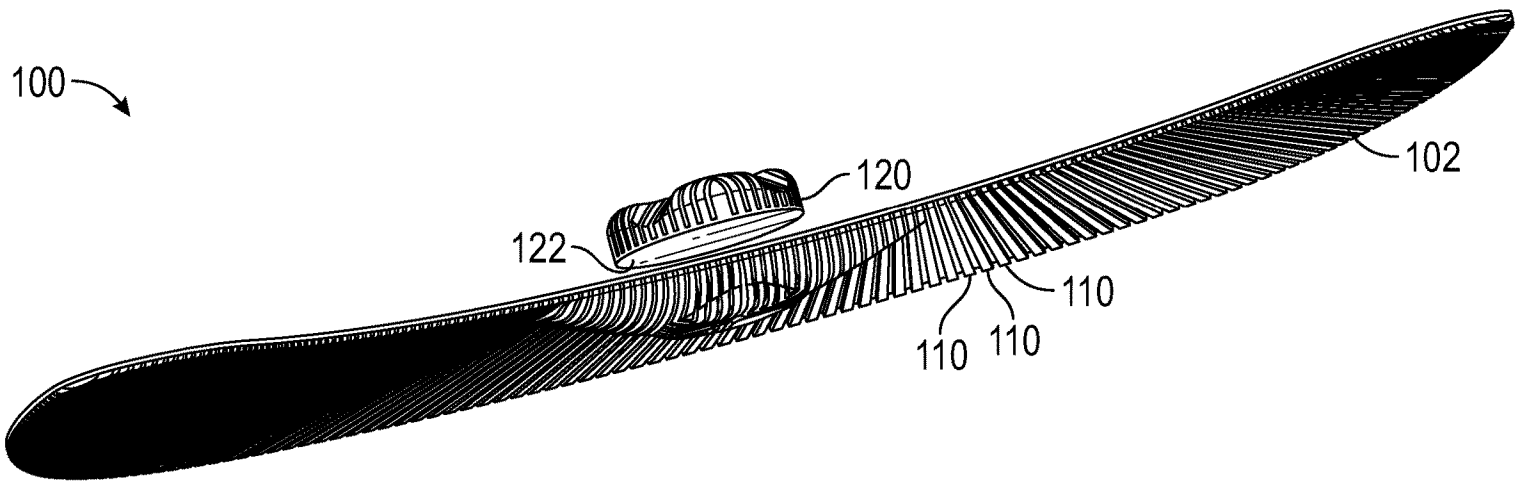
FIG. 2 is a bottom, rear, left side, perspective view of the visor system of FIG. 1.

The ridges and general shape of the auxiliary portion are seen to form four bumps to produce an x-shaped design (see, for example, FIG. 1). In other implementations these bumps could be excluded to provide a smoother configuration. When the bumps are included they may be useful for use with magnetic golf tees that seat into the grooves of the x shape so that the tees don't spin around.

Figure 10:
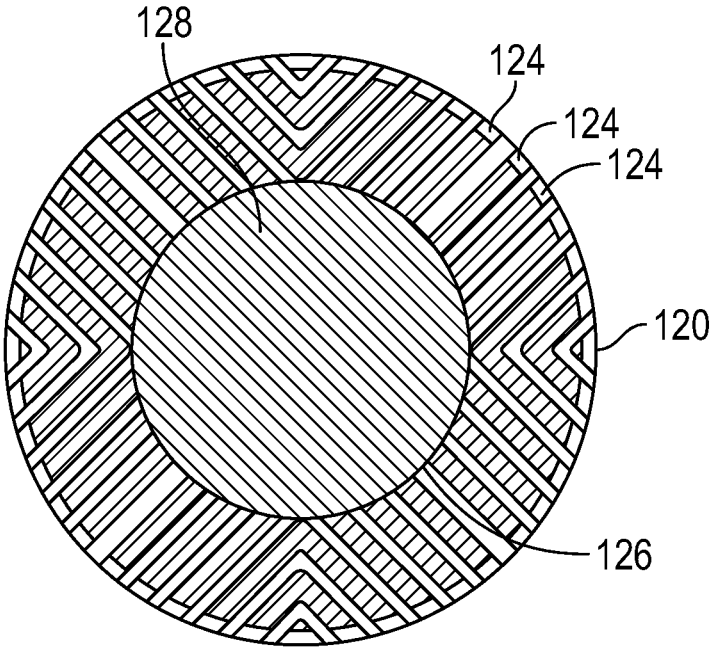
FIG. 10 is a top cross section of an auxiliary portion of the visor system of FIG. 1 looking directly toward a ridged side of the auxiliary portion.
Figure 11:
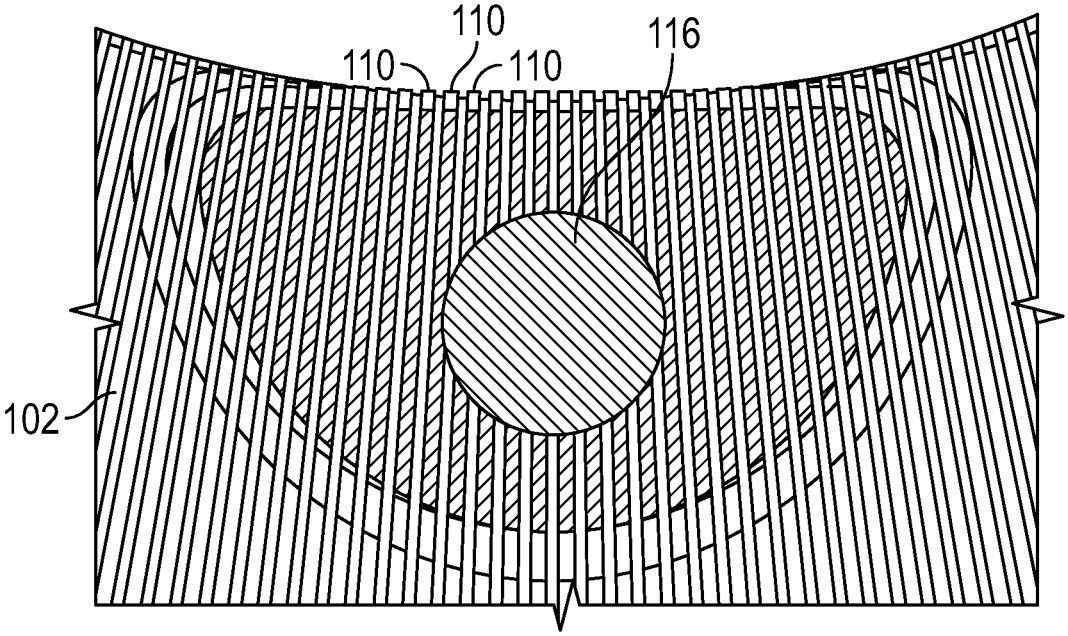
FIG. 11 is a top cross section of a bill portion of the visor system of FIG. 1 looking directly toward a ridged side of the bill portion.

In FIG. 10 the auxiliary portion top cross section is represented ridge side up (or ridges facing out of the page). In FIG. 11 the bill portion top cross section is represented ridge side up (or ridges facing out of the page).

In in-use configurations the bill portion may be slid to any position such as fully to the front, to either side at any angle or position, and so forth, to be used for additional shade and protection wherever the user desires it. The hat 200 itself may be rotated on the user's head as well so as to position both the bill 202 of the hat and the bill portion of the visor system in an advantageous position for providing shade to the user.

Although the visor systems are disclosed herein as being used together with a baseball cap, in other implementations they could be used with any other hat having a brim or visor, to extend the normal coverage of the brim or visor. Additionally, although the shape of the bill portion shown in the drawings is especially useful for use with a baseball cap (because of its generally resembling the shape of a baseball cap bill), in other implementations the shape of the bill portion may be modified to be wider or larger or to have a different shape so as to be especially useful when used in conjunction with a billed hat other than a baseball cap.

In implementations one of the magnets could be replaced with a magnetizable metal or other magnetizable material—for example magnet 116 could be a magnet and magnet 128 could be replaced with a magnetizable metal or material, or vice versa. In implementations, however, both may be magnets for added magnet strength. The magnets 116/128 and/or magnetizable elements together comprise at least one "magnetic pair," which is used herein to refer to a pair of two elements, one of which comprises a magnet and the other of which comprises either a magnet or a magnetizable metal or other magnetizable material.

As can be seen in the drawings, in the stowed position the upper side of the bill portion is fully covered by the hat bill and the ridges are on an underside of the bill portion.

FIG. 4 shows that the ridges form a fanned configuration that allows at least one gap between ridges, or a plurality of gaps between ridges, within a range of more than ninety degrees of rotation of the bill portion relative to the hat bill—along an axis of rotation passing through the bill portion and auxiliary portion in an in-use configuration (or in some cases perpendicular to flat surface 122)—to be parallel to an axis of bending of the hat bill. This allows the bill portion to conform to the curvature of the hat bill in a variety of positions. In implementations the range could be ninety degrees. In implementations the range could be greater than thirty degrees, greater than thirty-five degrees, greater than forty degrees, greater than forty-five degrees, greater than fifty degrees, greater than fifty-five degrees, greater than sixty degrees, greater than sixty-five degrees, greater than seventy degrees, greater than seventy-five degrees, greater than eighty degrees, greater than eighty-five degrees, greater than ninety degrees, greater than ninety-five degrees, greater than a hundred degrees, greater than a hundred and five degrees, greater than a hundred and ten degrees, greater than a hundred and fifteen degrees, greater than a hundred and twenty degrees, and so forth.

As used herein, the axis of bending of the baseball cap bill is meant to convey a traditional axis of bending of a baseball cap bill, along an axis that is parallel with the sides of the bill (as opposed to the front curved section or rear curved section of the bill)—a slight bending of this type can be seen in the bill 202 of FIG. 8.

The heat shields are seen to each cover a full surface of the respective magnets, though in implementations they could cover less, such as at least 80% of that surface or at least 90% of that surface. Covering the entire surface, however, ensures greater protection against heat so that the magnet is less likely to be demagnetized or to have its magnetization negatively affected during manufacturing.

In implementations the polymer or other encasings of the magnets may be or may include just enough material to soften the impact force in the event of a forceful impact between the magnets without the hat bill in between. In implementations the magnets are brittle enough that such impacts due to magnetic attraction could cause them to fracture, and their encasement within polymers or other materials, or their partial placement within cavities of the bill portion and auxiliary portion, respectively, may be sufficient to prevent this.

In some cases a magnet could be separately encased or partially encased in epoxy or a polymer and then later fixed to the bill portion via rivet, glue, or any other method permanent or non-permanent (instead of, for example, partially encasing the magnet in a cavity of the bill portion). In some cases one or more of the magnets, coupled to either the auxiliary portion or the bill portion, could be removable and interchangeable with other magnets having different strengths or gauss ratings to adapt to, or be used in conjunction with, different accessories (such as the cameras discussed above or for lights, etc.). For example, one interchangeable magnet for the bill portion could have a light (such as a light-emitting diode (LED)) and battery integrated therewith or coupled thereto so that such magnet couples to the underside of the bill portion to provide a light source under the bill, the magnet also being used to magnetically attract the auxiliary portion's magnet (or a separate magnet may be used to attract the auxiliary portion).

In some implementations the bill portion may be oversized so that it is larger than the hat bill it is coupled to, such as to provide additional shade and protection, etc. In such implementations, the bill portion may still have the general shape of a baseball cap bill, or it could have some other shape.

In places where the phrase "one of A and B" is used herein, including in the claims, wherein A and B are elements, the phrase shall have the meaning "A and/or B." This shall be extrapolated to as many elements as are recited in this manner, for example the phrase "one of A, B, and C" shall mean "A, B, and/or C," and so forth. To further clarify, the phrase "one of A, B, and C" would include implementations having: A only; B only; C only; A and B but not C; A and C but not B; B and C but not A; and A and B and C.

In places where the description above refers to specific implementations of visor systems and related methods, one or more or many modifications may be made without departing from the spirit and scope thereof. Details of any specific implementation/embodiment described herein may, wherever possible, be applied to any other specific implementation/embodiment described herein. The appended claims are to encompass within their scope all such changes and modifications as are within the true spirit and scope of this disclosure.

Furthermore, in the claims, if a specific number of an element is intended, such will be explicitly recited, and in the absence of such explicit recitation no such limitation exists. For example, the claims may include phrases such as "at least one" and "one or more" to introduce claim elements. The use of such phrases should not be construed to imply that the introduction of any other claim element by the indefinite article "a" or "an" limits that claim to only one such element, and the same holds true for the use in the claims of definite articles.

Additionally, in places where a claim below uses the term "first" as applied to an element, this does not imply that the claim requires a second (or more) of that element— if the claim does not explicitly recite a "second" of that element, the claim does not require a "second" of that element. Furthermore, in some cases a claim may recite a "second" or "third" or "fourth" (or so on) of an element, and this does not necessarily imply that the claim requires a first (or so on) of that element—if the claim does not explicitly recite a "first" (or so on) of that element (or an element with the same name, such as "a widget" and "a second widget"), then the claim does not require a "first" (or so on) of that element.

Method steps disclosed anywhere herein, including in the claims, may be performed in any feasible/possible order. Recitation of method steps in any given order in the claims or elsewhere does not imply that the steps must be performed in that order—such claims and descriptions are intended to cover the steps performed in any order except any orders which are technically impossible or not feasible. However, in some implementations method steps may be performed in the order(s) in which the steps are presented herein, including any order(s) presented in the claims.

What is claimed is:

1. A visor system, comprising:

a bill portion configured to bend enough to conform to a bent curvature of a hat bill, the bill portion comprising:
- a front curved section;
- a rear curved section; and
- a first component of a magnetic pair coupled with the bill portion; and an auxiliary portion, the auxiliary portion comprising a second component of the magnetic pair;

wherein the magnetic pair comprises a first magnet and one of a second magnet and a magnetizable material; and wherein an underside of the bill portion comprises a plurality of ridges separated by gaps.

2. The system of claim 1, wherein an upper side of the bill portion is sized and shaped to be fully covered by the hat bill when in a stowed position.

3. The system of claim 1, wherein the ridges comprise a fanned-out configuration.

4. The system of claim 1, wherein each of the ridges is wider at the front curved section than it is at the rear curved section.

5. The system of claim 1, wherein the bill portion further comprises a heat shield at least partially encapsulated therein and coupled with the first component of the magnetic pair.

6. The system of claim 5, wherein the heat shield is at least partially exposed through the bill portion.

7. The system of claim 5, wherein the heat shield is formed of one of a metal, a ceramic, and a composite material.

8. The system of claim 1, wherein the auxiliary portion further comprises a heat shield at least partially encapsulated therein and coupled with the second component of the magnetic pair.

9. The system of claim 8, wherein the heat shield is at least partially exposed through the auxiliary portion.

10. The system of claim 8, wherein the heat shield is formed of one of a metal, a ceramic, and a composite material.

11. The system of claim 1, wherein the first component of the magnetic pair is at least partially encapsulated within a cavity of the bill portion and is at least partially exposed through the bill portion.

12. The system of claim 1, wherein the second component of the magnetic pair is at least partially encapsulated within a cavity of the auxiliary portion and at least partially exposed through the auxiliary portion.

13. A visor system, comprising:

a bill portion configured to bend enough to conform to a bent curvature of a baseball cap bill, the bill portion comprising:
- a front curved section;
- a rear curved section;
- a plurality of ridges separated by gaps; and
- a first magnet at least partially encapsulated within a cavity of the bill portion; and an auxiliary portion, the auxiliary portion comprising a second magnet at least partially encapsulated within a cavity of the auxiliary portion.

14. The system of claim 13, wherein the ridges form a circular, fanned configuration fanned out from a common axis, the common axis not intersecting the bill portion but being closer to the rear curved section than to the front curved section.

15. The system of claim 13, wherein the ridges form a fanned configuration such that, within a range of at least ninety degrees of rotation of the bill portion relative to the baseball cap bill, along an axis of rotation passing through the auxiliary portion and the bill portion when magnetically coupled together, at least one of the gaps is parallel to an axis of bending of the baseball cap bill.

16. The system of claim 13, wherein the auxiliary portion comprises a plurality of bumps at least partially forming an X shape.

17. The system of claim 13, wherein the bill portion further comprises a first heat shield completely covering a surface of the first magnet, and wherein the auxiliary portion comprises a second heat shield completely covering a surface of the second magnet.

18. A method of use of a visor system, comprising:

coupling a bill portion of a visor system under a hat bill such that the bill portion bends to match a bent curvature of the hat bill and such that the hat bill fully covers an upper side of the bill portion; and coupling an auxiliary portion of the visor system over the hat bill such that a first component of a magnetic pair, at least partially encapsulated within the bill portion, magnetically couples with a second component of the magnetic pair at least partially encapsulated within the auxiliary portion, the magnetic pair retaining the visor system in a stowed configuration, wherein the magnetic pair comprises a first magnet and one of a second magnet and a magnetizable material.

19. The method of claim 18, further comprising moving the bill portion to an in-use position such that the hat bill does not fully cover the upper side of the bill portion, and rotating the bill portion along an axis passing through the bill portion and the auxiliary portion, wherein the auxiliary portion automatically follows the movement of the bill portion due to the magnetic pair being magnetically coupled, and wherein the bill portion automatically bends to conform to the bent curvature of the hat bill upon movement and rotation of the bill portion.

* * * * *